US005779987A

United States Patent [19]

Huang

[11] Patent Number: 5,779,987

[45] Date of Patent: Jul. 14, 1998

[54] ABDOMEN TRAINING DEVICE

[76] Inventor: Kou-Ming Huang, No. 181, Lane 412, Chenhsing Road, Taichung, Taiwan

[21] Appl. No.: 855,167

[22] Filed: May 13, 1997

[51] Int. Cl.[6] ..... A63B 21/02

[52] U.S. Cl. ..... 482/140; 482/128; 482/122; 482/129

[58] Field of Search ..... 482/121, 122, 482/123, 124, 129, 130, 140, 128

[56] References Cited

U.S. PATENT DOCUMENTS

| | | | |
|---|---|---|---|
| 4,830,367 | 5/1989 | Foran | 482/140 |
| 5,069,444 | 12/1991 | Wilkinson | 482/128 |
| 5,094,450 | 3/1992 | Stearns | 482/130 |
| 5,256,126 | 10/1993 | Grotstein | 482/130 |
| 5,441,473 | 8/1995 | Safani et al. | 482/140 |
| 5,616,109 | 4/1997 | Szu-Ming | 482/129 |
| 5,669,863 | 9/1997 | Ho | 482/129 |

*Primary Examiner*—Lynne A. Reichard

*Attorney, Agent, or Firm*—Pro-Techtor International

[57] ABSTRACT

The present invention relates to an abdomen training device, comprising: a base frame, carrying a positioning frame, with a support being mounted on the positioning frame; and an abdomen training element, mounted on the support and further comprising an accommodating part, a spring, inserted into the accommodating part close to the front end thereof, a gliding bar, inserted into the accommodating part, the front end of the gliding bar leaning against the rear end of the spring, the rear end of the gliding bar extending beyond the rear end of the accommodating part, the gliding bar gliding inside the accommodating part along the longitudinal axis, and a rest plate, attached to the rear end of the gliding bar, having a rear surface, which is pressed against by the abdomen of a user; wherein during an exercise the user, contracting her or his abdominal muscles, pushes the rest plate and the gliding bar towards the front end of the abdomen training element against an elastic force caused by the spring and subsequently, releasing her or his abdominal muscles, allows the rest plate to return.

13 Claims, 7 Drawing Sheets

ABDOMEN TRAINING DEVICE

BACKGROUND OF THE INVENTION

1. Field of the Invention

The present invention relates to an abdomen training device, particularly to an abdomen training device for effective exercise.

2. Description of Related Art

Life in modern cities has become hectic, with increasing working hours and decreasing leisure time. People often lack physical exercise and thus develop a sizable belly. On the other hand, physical health and beauty are increasingly valued, so there has been a considerable demand for training devices. Devices for training and slimming the-abdomen have been developed.

Conventional training devices for the abdomen have a base frame with a pair of handles and a vertical bar with a gliding plate gliding thereon. An elastic strap limits the movement of the gliding plate. The user leans with her or his belly against the gliding plate and holds the pair of handles with the hands, trying to move the gliding plate against the base frame to train the abdominal muscles. However, since in such a training device force is applied mainly by the hands, with the abdomen hardly moving, there is little training effect.

SUMMARY OF THE INVENTION

An object of the present invention is to provide an abdomen training device, which effectively trains the abdomen.

Another object of the present invention is to provide an abdomen training device, which lets the abdominal muscles stretch out, contract and release.

The present invention can be more fully understood by reference to the following description and accompanying drawings.

DETAILED DESCRIPTION OF THE PREFERRED EMBODIMENTS

As shown in all FIGS., the abdomen training device of the present invention mainly comprises: a base frame 10, which is stably mounted on a base or on a floor and carries a positioning frame 11; and an abdomen training element 20, which is attached to the positioning frame 11. The user pushes against the abdomen training element 20, with the base frame 10 in a fixed position providing the counterforce, thus contracting and releasing the abdominal muscles.

Figure 1:
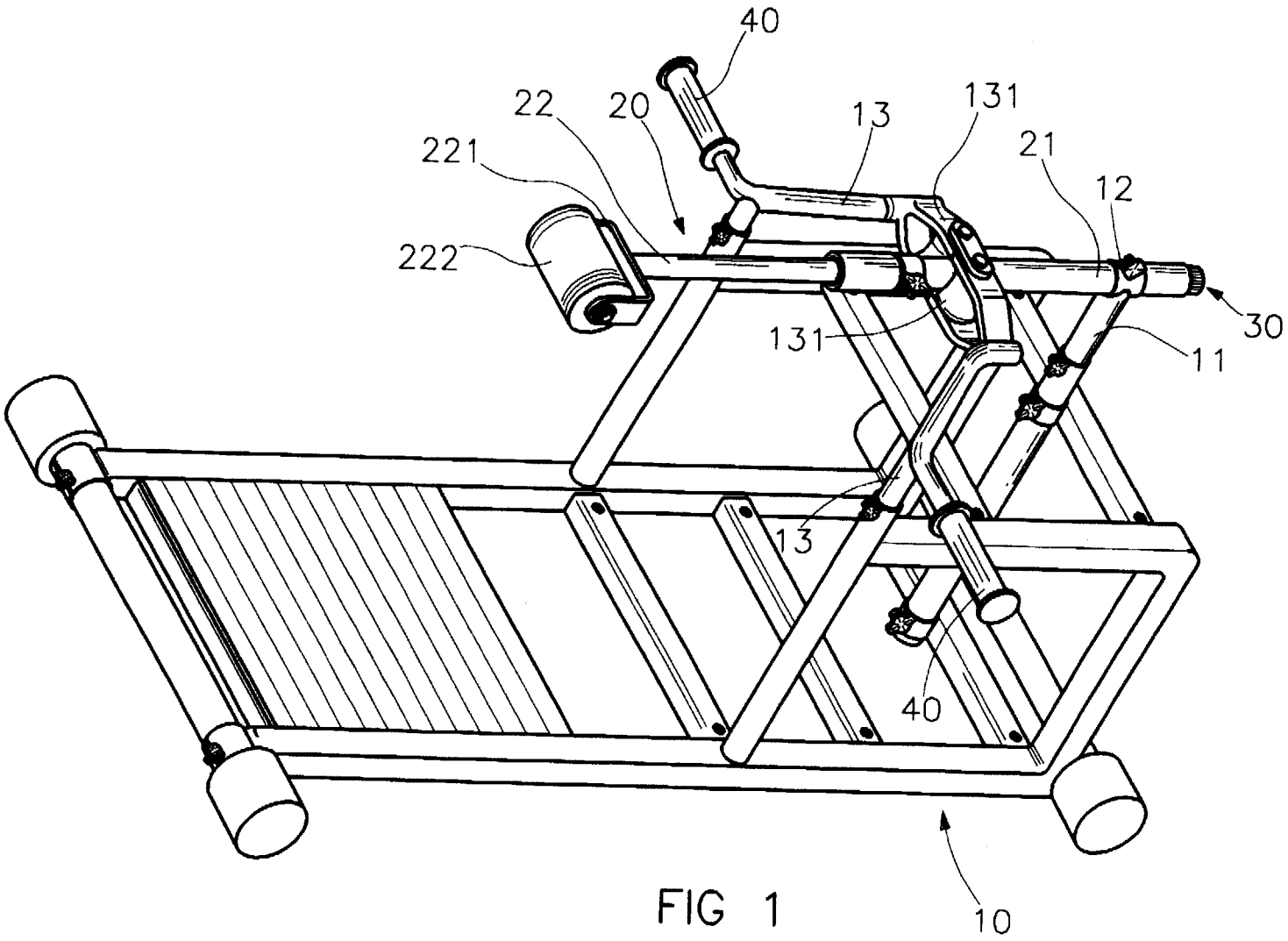
FIG. 1 is a perspective view of the abdomen training device of the present invention.

Referring to FIG. 1, the base frame 10 has a front end and a rear end. The positioning frame 11 is a vertical bar, mounted on the front end of the base frame 10. On the upper end of the positioning frame 11, a support 12 is attached. The support 12 has a clamp, which holds the abdomen training element 20, such that the abdomen training element 20 is fixed with respect to the base frame 10. By loosening the clamp, the abdomen training element 20 is detachable from the base frame 10.

Figure 2:
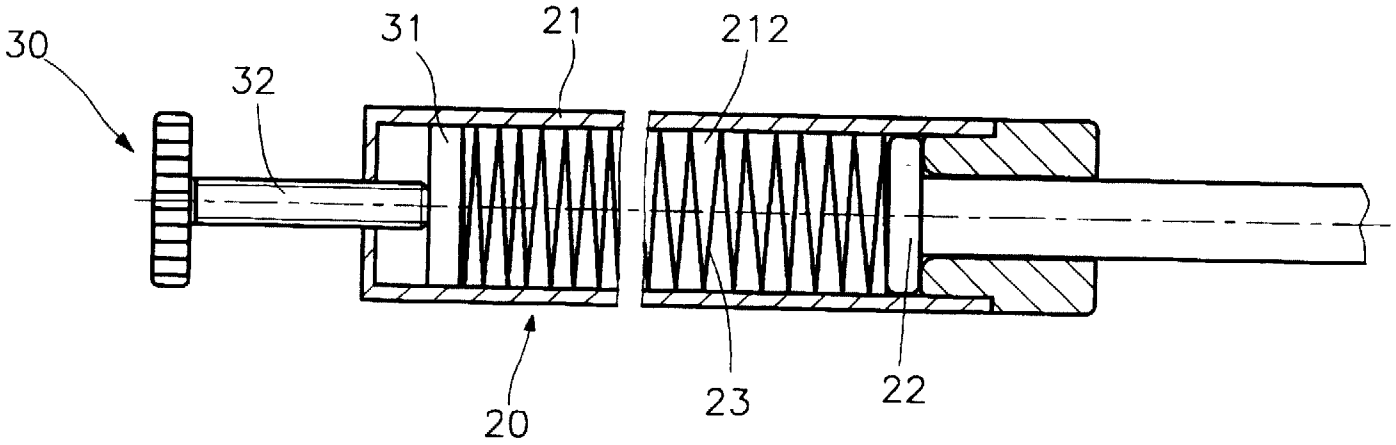
FIG. 2 is a schematic illustration of the elastic element of the present invention.

Referring to FIGS. 1 and 2, the abdomen training element 20 has an accommodating part 21 with a front end held by the support 12 and a rear end, which extends horizontally towards the rear end of the base frame 10. Inside the accommodating part 21, a longitudinal gliding path 212 accommodates a spring 23 and a gliding bar 22, which is glidable inside the gliding path 212.

The gliding bar 22 extends parallel to the accommodating part 21 beyond the rear end thereof. On the rear end of the gliding bar 22, a rest plate 221 is fixed, which in turn carries a roller 222 made of soft material. During the exercise, the user leans on the roller 222, facing the front end of the base 10. The roller 222 allows for a slight movement of the user's abdomen up and down. The front end of the gliding bar 22 stays inside the accommodating part 21, leaning against the spring 23. When the user presses against the roller 222, the gliding bar 22 is pushed towards the front end of the accommodating part 21, against the elastic force of the spring 23. When the user releases the muscles of her or his abdomen, the elastic force of the spring 23 pushes back the gliding bar 22. Thereby the abdominal muscles of the user are trained for contracting against a counterforce and releasing.

The front end of the spring 23 leans against an adjusting element 30. The adjusting element 30 allows to control the longitudinal position of the front end of the spring 23 within the accommodating part 21, thus controlling the counterforce the user experiences, when she or he presses against the roller 222. The adjusting element 30 has a rear end with a press plate 31 pressed on by the front end of the spring 23. A screw 32 passes through a threaded hole in the front end of the accommodating part 21, extending into the accommodating part 21 with variable depth. Its tip presses on the press plate 31, adjusting the longitudinal position of the press plate 31 within the accommodating part 21. Thus the counterforce against pushing forward the gliding bar 22 by a given displacement is adjusted.

Figure 3:
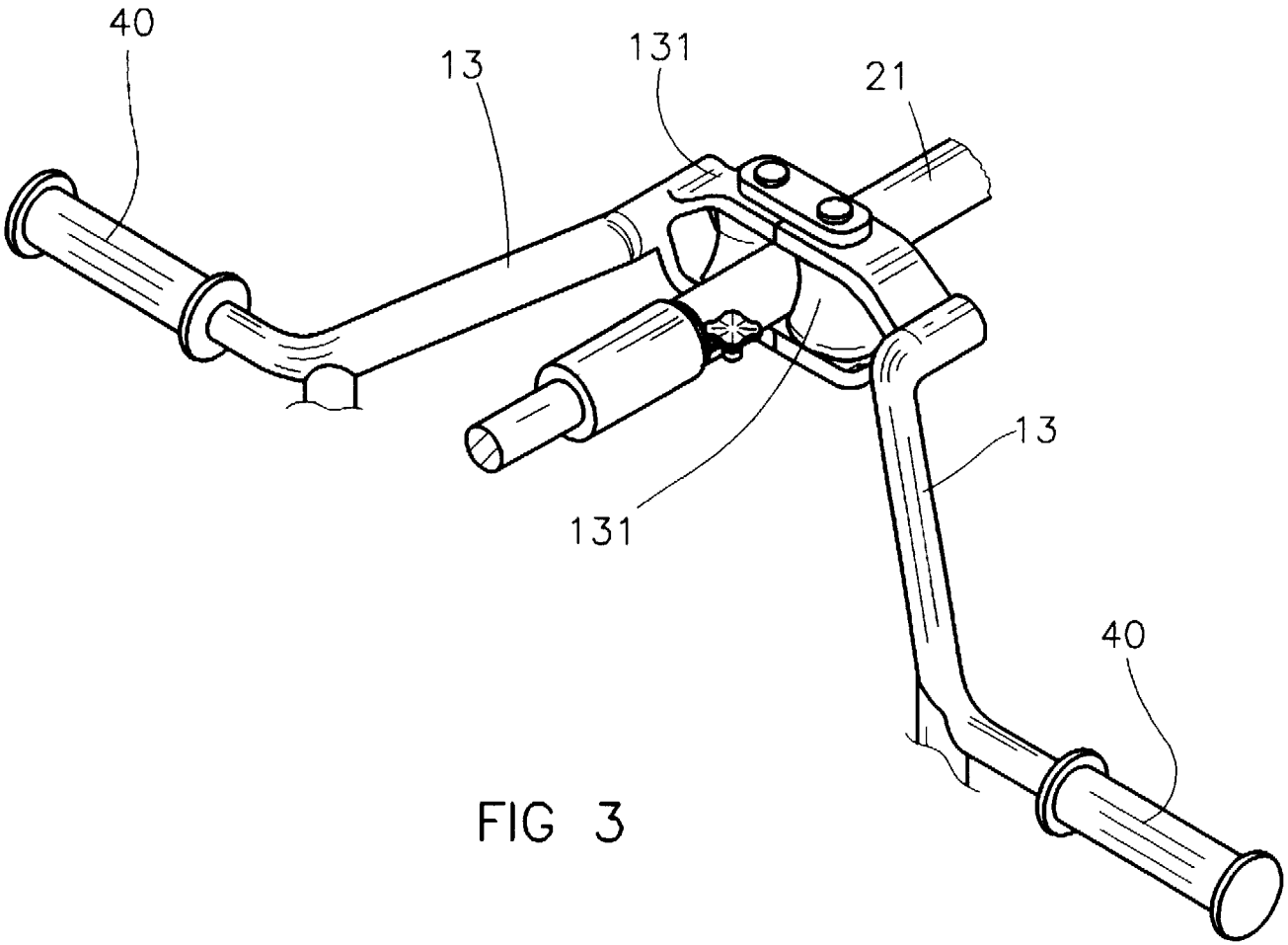
FIG. 3 is a schematic illustration of the handrest and the handles of the present invention.

As shown in FIGS. 1 and 3, a handrest 13 is mounted on the base frame 10 on the two lateral sides thereof. The handrest 13 has a clamp 131, holding the accommodation part 21 close to the rear end thereof and thus providing further support for the abdomen training element 20. The handrest has two lateral ends, on which two handles 40 are mounted. The user holds the handles with her or his hands to preserve her or his stand during the exercise, when she or he is not yet experienced with the abdomen training device of the present invention.

Figure 4:
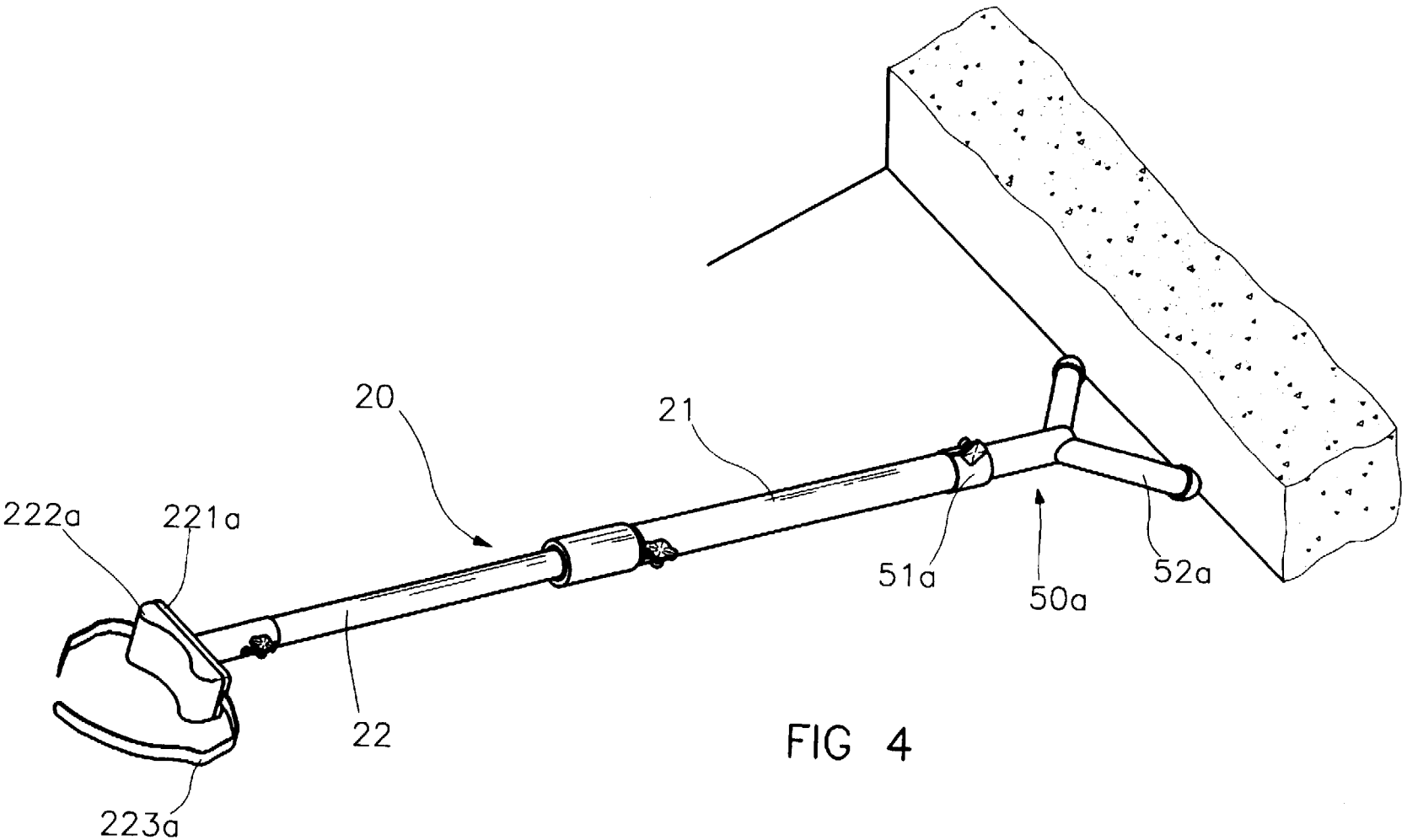
FIG. 4 and 5 are perspective views of the abdomen training device of the present invention in a second embodiment, where a wall provides support.
Figure 5:
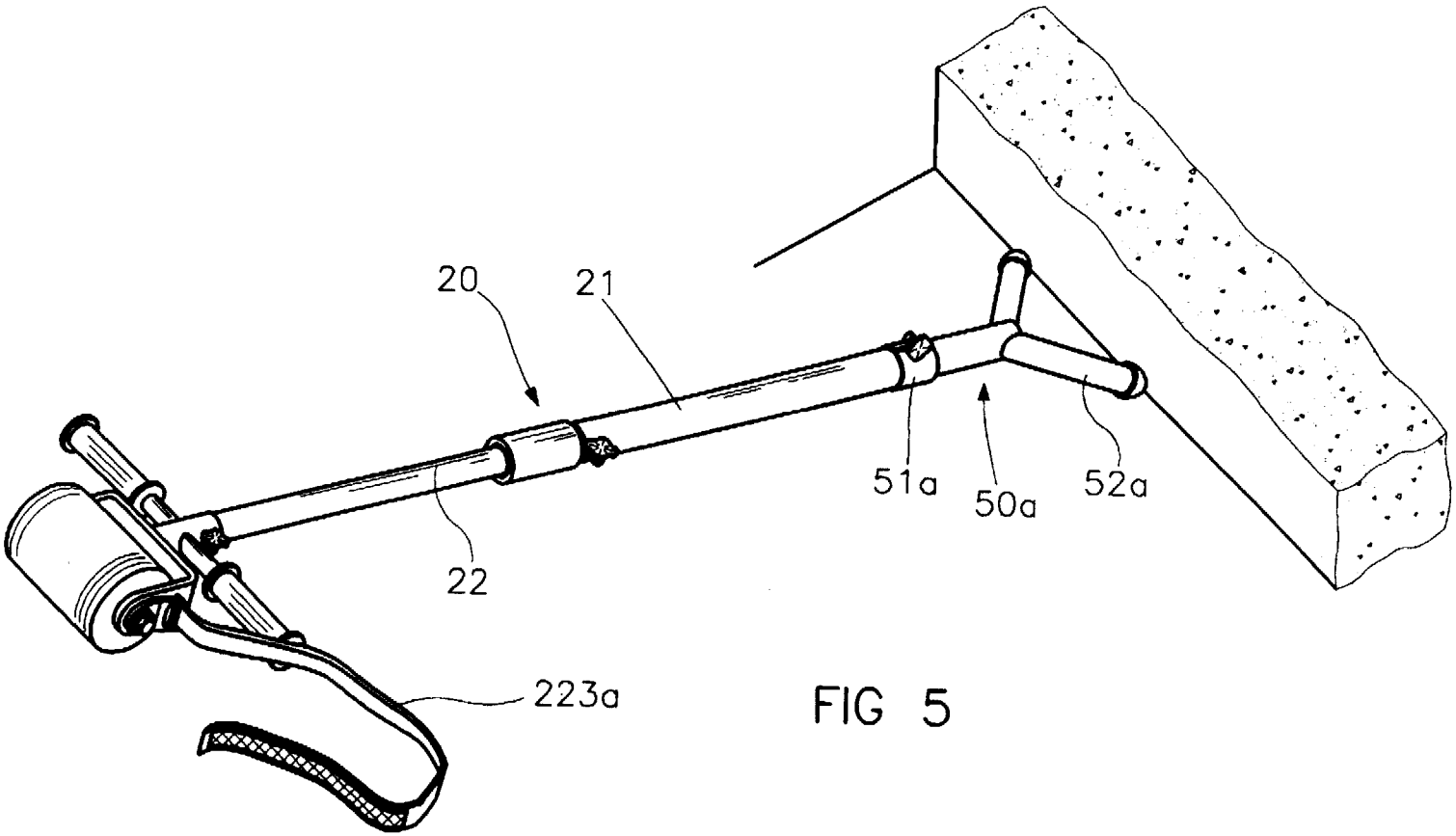

Referring to FIGS. 4 and 5, the abdomen training device of the present invention in a second embodiment is operated separate from the base frame 10 (shown in FIG. 1). In this embodiment, a front support **50*a* is attached to the front end of the abdomen training element 20. The front support 50*a* has a clamp 51*a*, which holds the front end of the accommodation part 21, and two feet 52*a* for supporting the abdomen training element 20 against a wall or another stable surface. The feet 52*a* are horizontally separated, allowing for a vertical movement of the rear end of the abdomen training element. During the exercise, the user kneels in front of a wall, pressing on the rear end of the abdomen training element 20, with the feet 52***a* of the front support 50*a* in turn pressing against the wall. Thus the user not only trains the abdominal muscles, but also the thigh.

On the rear end of the gliding bar 21, a rest plate 221*a* is hingedly mounted, being movable up and down. The rest plate 221*a* has a rear surface with a curvature that follows the user's abdomen. A cushion 222*a* is attached on the rear surface of the rest plate 221*a*, and a strap 223*a* is attached to one side of the rest plate 221*a* to be wound around the user's abdomen. Thus the user is firmly connected to the abdomen training element 20. At the same time, slight movements of the user's abdomen are followed by the rest plate 221*a*. A shown in FIG. 5, the rest plate 221*a* with the cushion 222*a* are substitutable by the rest plate 221 and the roller 222. The strap 223*a* is attached to the rest plate 221 by a shackle that is turnable around the axis of the roller 222 to follow vertical movements of the user's abdomen against the rest plate 221.

Figure 6:
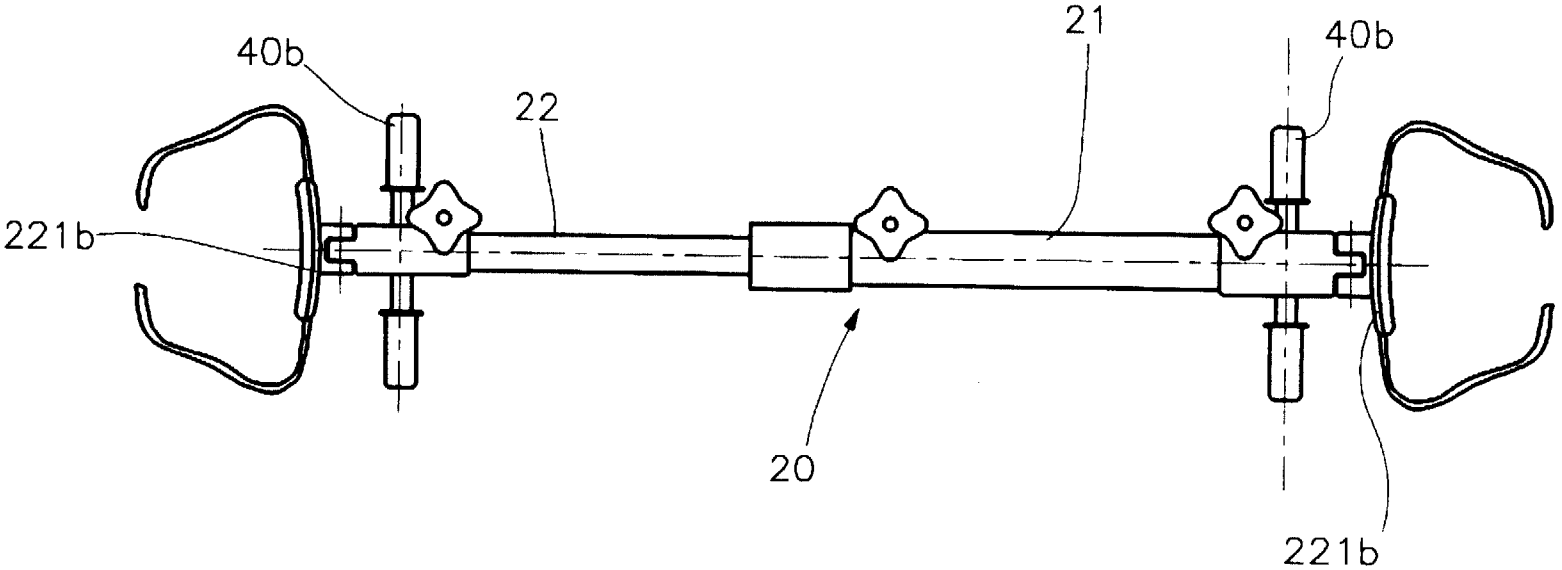
FIG. 6 and 7 are perspective views of the abdomen training device of the present invention in a third embodiment for use by two persons.
Figure 7:
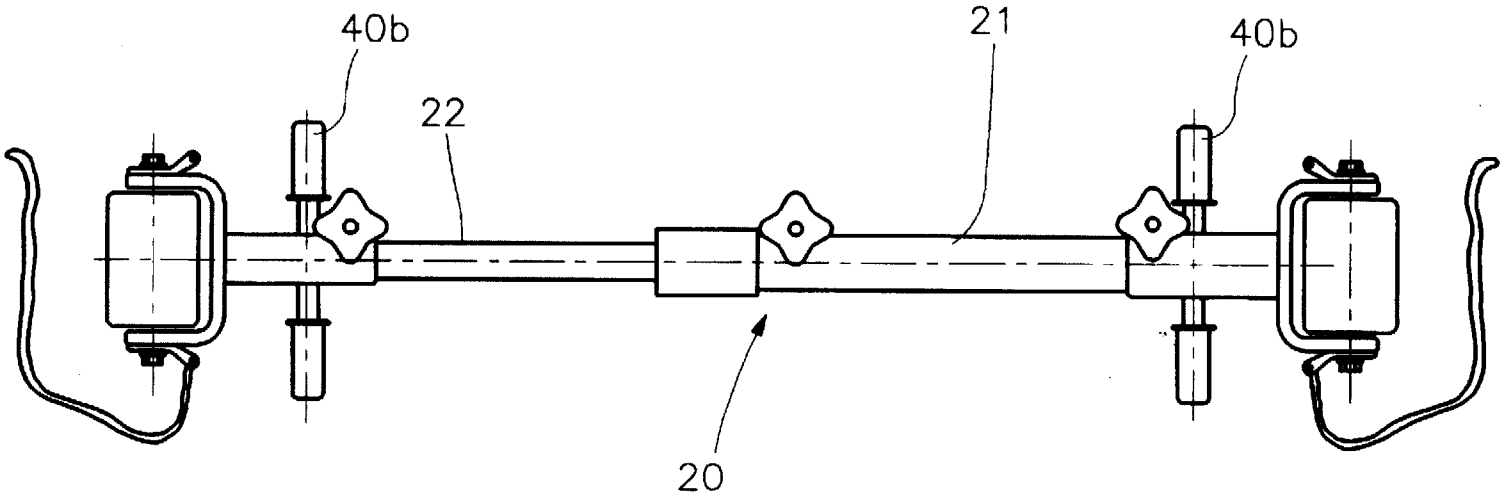

Referring to FIGS. 6 and 7, the abdomen training device of the present invention in a third embodiment is operated separate from the base frame 10 (shown in FIG. 1). In this embodiment, two users face each other, pressing against the front end and the rear end of the abdomen training element 20, respectively. On the front end of the accommodating part 21 and the rear end of the gliding bar 22, two rest plates 221*b* are mounted, each of them being like the rest plate 221 or like the rest plate 221*a* of the second embodiment of the present invention, carrying a roller or a cushion. The two users press the abdomen training element 20 against each other, both training their abdominal muscles.

Close to each of the rest plates 221*b*, a pair of handles 40*b* is mounted, so as to preserve the balance of the users during the exercise.

While the invention has been described with reference to preferred embodiments thereof, it is to be understood that modifications or variations may be easily made without departing from the spirit of this invention which is defined by the appended claims.

What is claimed is:

1. An abdomen training devices comprising:

a base frame, carrying a positioning frame with an upper end, a support being mounted on said upper end; and an abdomen training element with a front end, a rear end and a longitudinal axis, mounted on said support and further comprising an accommodating part with a front end and a rear end, a spring with a front end and a rear end, inserted into said accommodating part close to said front end thereof, a gliding bar with a front end and a rear end, inserted into said accommodating part, said front end of said gliding bar leaning against said rear end of said spring, said rear end of said gliding bar extending beyond said rear end of said accommodating part, said gliding bar gliding inside said accommodating part along said longitudinal axis, and a rest plate, attached to said rear end of said gliding bar, having a rear surface, which is pressed against by the abdomen of a user;

wherein during an exercise said user, contracting her or his abdominal muscles, pushes said rest plate and said gliding bar towards said front end of said abdomen training element against an elastic force caused by said spring and subsequently, releasing her or his abdominal muscles, allows said rest plate to return.

2. An abdomen training device according to claim 1, wherein said abdomen training element is separable from said support.

3. An abdomen training device according to claim 2, wherein a front support is attached to said front end of said abdomen training element for supporting said abdomen training element, when pressed against a wall or another stable surface.

4. An abdomen training device according to claim 3, wherein said front support has a front end with two horizontally separated feet, allowing for a vertical movement of said rear end of said abdomen training element.

5. An abdomen training device according to claim 2, wherein a rest plate with a binding device is attached to said rear end of said gliding bar of said abdomen training element for binding said user's abdomen to said abdomen training element.

6. An abdomen training device according to claim 5, wherein said user is bound to said rest plate by a strap.

7. An abdomen training device according to claim 2, wherein two rest plates are attached to said front end of said accommodating part and to said rear end of said gliding bar of said abdomen training element, allowing two users to exercise together.

8. An abdomen training device according to claim 7, wherein a pair of handles is attached to each of said two rest plates, so as to preserve a safe stand for said two users.

9. An abdomen training device according to claim 1, wherein a handrest is mounted on said base frame, said handrest supporting said accommodating part close to said rear end thereof and preserving a safe stand for said user.

10. An abdomen training device according to claim 9, wherein a pair of handles is attached to said handrest.

11. An abdomen training device according to claim 1, wherein an adjusting element is inserted between said front end of said abdomen training element and said front end of said spring, so as to adjust said elastic force for a given displacement of said gliding bar.

12. An abdomen training device according to claim 11, wherein said adjusting element comprises:

a screw, passing through a threaded hole in said front end of said accommodating part and extending into said accommodating part with an adjustable depth along said longitudinal axis; and a press plate, having a front surface pressed on by said screw and a rear surface leaning against said spring;

wherein adjusting said depth controls said elastic force for a given displacement of said gliding bar.

13. An abdomen training device according to claim 1, wherein a roller of soft material is mounted on said rest plate.

* * * * *